US011230108B2

(12) United States Patent
Cahill et al.

(10) Patent No.: US 11,230,108 B2
(45) Date of Patent: Jan. 25, 2022

(54) FLUID CONTAINERS

(71) Applicant: HEWLETT-PACKARD DEVELOPMENT COMPANY, L.P., Spring, TX (US)

(72) Inventors: Eugene Cahill, Leixlip (IE); Brian Cronly, Leixlip (IE); Brian Walsh, Leixlip (IE); James Mannion, Leixlip (IE); Cormac O'Beirne, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 174 days.

(21) Appl. No.: 16/481,695

(22) PCT Filed: Apr. 24, 2017

(86) PCT No.: PCT/US2017/029095
§ 371 (c)(1),
(2) Date: Jul. 29, 2019

(87) PCT Pub. No.: WO2018/199883
PCT Pub. Date: Nov. 1, 2018

(65) Prior Publication Data
US 2021/0129544 A1 May 6, 2021

(51) Int. Cl.
*B41J 2/175* (2006.01)

(52) U.S. Cl.
CPC ..... *B41J 2/17513* (2013.01); *B41J 2/17556* (2013.01)

(58) Field of Classification Search
CPC ..... B41J 2/17513; B41J 2/17556
See application file for complete search history.

(56) References Cited

U.S. PATENT DOCUMENTS

| | | | |
|---|---|---|---|
| 5,742,312 | A | 4/1998 | Carlotta |
| 7,125,108 | B2 | 10/2006 | Toba et al. |
| 7,699,451 | B2 | 4/2010 | Nishida |
| 7,950,764 | B2 | 5/2011 | Kobayashi |

(Continued)

FOREIGN PATENT DOCUMENTS

| | | |
|---|---|---|
| CN | 102049900 | 5/2011 |
| CN | 103213400 | 7/2013 |

(Continued)

*Primary Examiner* — Justin Seo
(74) *Attorney, Agent, or Firm* — Fabian VanCott

(57) ABSTRACT

There is disclosed a fluid container 200 useable with print apparatus. The fluid container comprises a primary module 210 comprising: a primary reservoir 220 to contain print fluid and a regulated chamber 230 to receive the print fluid from the primary reservoir 220. The regulated chamber 203 comprises a regulator unit 232 to actuate a gas control valve 234 to control a flow of relief gas into the fluid container 200 as print fluid is discharged from the fluid container 200. The fluid container comprises a secondary module 250 comprising a secondary reservoir 252 to contain print fluid. The primary reservoir 220 is to receive the print fluid from the secondary reservoir 252 via a re-supply conduit 260 between the secondary reservoir 252 and the primary reservoir 220. The secondary reservoir 252 is to receive the relief gas via the gas control valve 234, and the primary reservoir 220 is to receive the relief gas via the secondary reservoir 252.

20 Claims, 6 Drawing Sheets

(56) References Cited

U.S. PATENT DOCUMENTS

| | | | | |
|---|---|---|---|---|
| 9,090,082 | B2 | 7/2015 | Boyd et al. | |
| 9,315,030 | B2 | 4/2016 | Boyd et al. | |
| 2008/0143763 | A1* | 6/2008 | Sakurai | B41J 2/1707 347/6 |
| 2012/0001989 | A1 | 1/2012 | Silverbrook | |
| 2012/0026255 | A1 | 2/2012 | Park | |
| 2012/0268507 | A1 | 10/2012 | Asami | |

FOREIGN PATENT DOCUMENTS

| | | | |
|---|---|---|---|
| CN | 103282209 | | 9/2013 |
| CN | 105922740 | | 9/2016 |
| EP | 2905142 | A2 | 8/2015 |
| WO | WO-2012094018 | A1 | 7/2012 |
| WO | WO-2012168913 | A1 | 12/2012 |
| WO | WO-2017019101 | A1 | 2/2017 |

* cited by examiner

FLUID CONTAINERS

BACKGROUND

Print devices such as inkjet printers and 3D printers (otherwise referred to as additive manufacturing devices) may eject a print fluid such as ink or another agent onto a medium in operation, such as a print media (e.g. in sheet form) or a build material in the context of additive manufacturing. Such print devices may be provided with an integral or removable fluid container for storing such a print fluid.

Additive manufacturing systems that generate three-dimensional objects on a layer-by-layer basis have been proposed as a potentially convenient way to produce three-dimensional objects.

BRIEF DESCRIPTION OF DRAWINGS

Examples will now be described, by way of non-limiting example, with reference to the accompanying drawings, in which.

DETAILED DESCRIPTION

Figure 1:
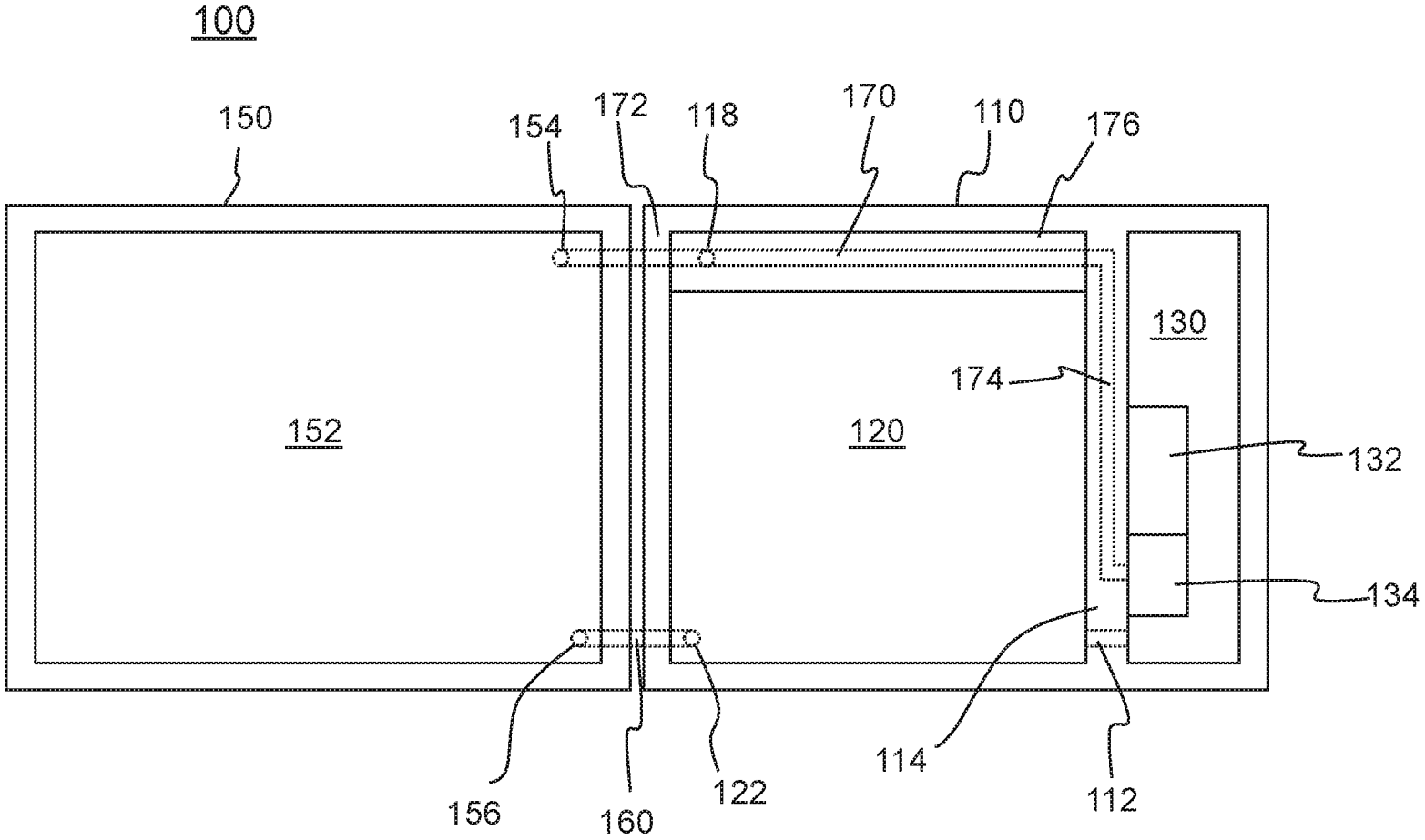
FIG. 1 schematically shows an example fluid container in cross-sectional view.

FIG. 1 shows an example fluid container 100 useable with a print apparatus such as an inkjet printer or additive manufacturing apparatus (3D printer or three-dimensional printer), The fluid container 100 comprises a primary module 110 and a secondary module 150. The primary module comprises a primary reservoir 120 to contain print fluid, such as an ink or other print agent. The primary module further comprises a regulated chamber 130 to receive print agent from the primary reservoir 120. In this example, the primary module comprises a primary re-supply conduit 112 provided in a lower portion of a first wall 114 of the primary module 110 between the primary reservoir 120 and the regulated chamber 130 to supply print fluid from the primary reservoir 120 to the regulated chamber 130. The primary reservoir 120 may otherwise be referred to as a "free-ink chamber".

The fluid container 100 further comprises a regulator unit 132 disposed within the regulated chamber 130. In this example, the regulator unit 132 is to move between at least two configurations to control a gas control valve 134, which in turn controls a flow of relief gas into the fluid container 100 as print fluid is discharged therefrom. For example, the regulator unit 132 may comprise a sealed expandable chamber to expand and contract in response to pressure changes within the regulated chamber 132, In other examples, the regulator unit may comprise a spring. In some examples, the regulator unit 132 may be passively actuating. The regulator unit 132 may comprise an actuator for actively moving it between configurations, for example in response to a control signal. For example, the regulator unit 132 may be to expand in response to a signal relating to a priming operation so as to act on the print fluid and cause it to be discharged.

The regulator unit 132 is to actuate a gas control valve 134 to control a flow of relief gas into the fluid container 100 as print fluid is discharged therefrom. For example, following a print operation in which print fluid is discharged from the regulated chamber, the regulator unit 132 may respond to a consequent change in pressure in the regulated chamber 130 to actuate the gas control valve to open, thereby allowing a flow of relief gas into another part of the fluid container, as will be described in detail below.

In this example, the gas control valve 134 is partly disposed in the regulated chamber 130. In this particular example, the gas control valve 134 comprises a valve member disposed within the regulated chamber 130 and a valve seat formed by the first wall 114 separating the primary reservoir 120 and the regulated chamber 130.

By dividing the primary module 110 into a regulated chamber 130 for discharging print fluid and a separate primary reservoir 120 for storing a supply of print fluid for the regulated chamber, the discharge of ink from the regulated chamber 130 or other controlled operations (such as the opening of the gas control valve 134) may be controlled independent of a volume fraction of relief gas in the primary module. For example, the primary reservoir 120 may be to receive relief gas to replace print fluid provided to the regulated chamber, and the primary reservoir 120 may be fluidically coupled to the regulated chamber 130 such that relief gas is first provided to the regulated chamber when a supply of print fluid in the primary reservoir 120 is substantially depleted. For example, the primary re-supply conduit 112 may be disposed towards a lower end of the primary reservoir 120.

As shown in FIG. 1, the fluid container 100 further comprises a secondary module 150 comprising a secondary reservoir 152 to contain print fluid. The secondary reservoir 152 may otherwise be referred to as an auxiliary reservoir. The primary reservoir 120 is to receive print fluid from the secondary reservoir via a secondary re-supply conduit 160 between the secondary reservoir 152 and the primary reservoir 120. In this example, the primary module 110 and the secondary module 150 are discrete modules structurally connected to one another. In other words, they do not share a common wall or there is a gap between adjacent walls of the two modules 110, 150. In this example, the secondary re-supply conduit 160 comprises a conduit extending between respective ports of the secondary module 150 and the primary module 120 to fluidically connect the secondary reservoir 152 and the primary reservoir 120. In this particular example, the secondary re-supply conduit 160 is coupled to the reservoirs 152, 120 towards their lower ends.

As shown in FIG. 1, the secondary reservoir 152 is to receive relief gas from the gas control valve 134 via a relief gas pathway 170, and the primary reservoir 120 is to receive relief gas via the secondary reservoir 152. Accordingly, as print fluid is discharged from the regulated chamber it is replenished by a flow of print fluid from the primary reservoir 120 (via the primary re-supply conduit) which in turn is replenished by a flow of print fluid from the secondary reservoir 152. A flow of relief gas is provided to the secondary reservoir 152 via the gas control valve 134 such that the level of print fluid in the secondary reservoir 152 reduces whilst the level of print fluid in the primary reservoir 120 and regulated is initially maintained. In this example, once the level of print fluid in the secondary reservoir 152 reduces to a threshold corresponding to the level of the outlet to the secondary re-supply conduit 160, further discharge of print fluid from the fluid container 100 causes the relief gas to flow through the secondary re-supply conduit 160 to the primary reservoir 120 where it collects in an upper portion of the reservoir 120. Similarly, subsequent depletion of print fluid in the primary reservoir 120 to a threshold level corresponding to the outlet to the primary re-supply conduit 112 would permit relief gas to flow to the regulated chamber 130 via the primary re-supply conduit.

In the example fluid container of FIG. 1, the secondary reservoir 152 is to receive relief gas from the gas control valve in the primary module 110 via the relief gas pathway 170 which bypasses the primary reservoir 120. The primary module 110 of this example has an upper port 118 and a lower port 122 for fluid communication with an upper port 154 and a lower port 156 of the secondary module 150 respectively. The lower ports 122, 156 of the primary and secondary modules 110, 150 respectively are coupled by the secondary re-supply conduit 160 as described above for re-supply of print fluid and subsequently relief gas from the secondary reservoir 152 to the primary reservoir 120.

In this example, the upper ports 118, 154 of the primary and secondary modules 110, 150 respectively are coupled by a relief conduit 172 forming part of the relief gas pathway 170. The relief conduit 172 may be external to the modules 110, 150. As shown in FIG. 1, in this example the upper port 118, 154 of each module is located above the respective lower port 122, 156 of the module.

In the example fluid container 100 of FIG. 1, the lower port 122 of the primary module 110 is in direct fluid communication with the primary reservoir 120, whereas the upper port 118 of the primary module 110 is separate from the primary reservoir 120 and indirectly fluidically coupled to the primary reservoir 120 via the secondary reservoir. The upper and lower ports 154, 156 of the secondary module 150 may be in direct fluid communication with the secondary reservoir 152.

In this example, the relief gas pathway 170 comprises a bypass portion 174 extending along the first wall 114 separating the regulated chamber 130 and the primary reservoir. As shown in FIG. 1, in this example the relief gas pathway 170 further comprises an outlet chamber 176 disposed within the primary module 110 and separate from the primary reservoir 120. The outlet chamber 176 is to receive relief gas from the bypass portion 174 and discharge the relief gas from the primary module 110. The upper port 118 of the primary module may open into the outlet chamber 176. The outlet chamber may be to discharge relief gas from the primary module via the upper port 118. The outlet chamber 176 may be separated from the primary reservoir 120 by a second wall of the primary module 110.

Figure 2:
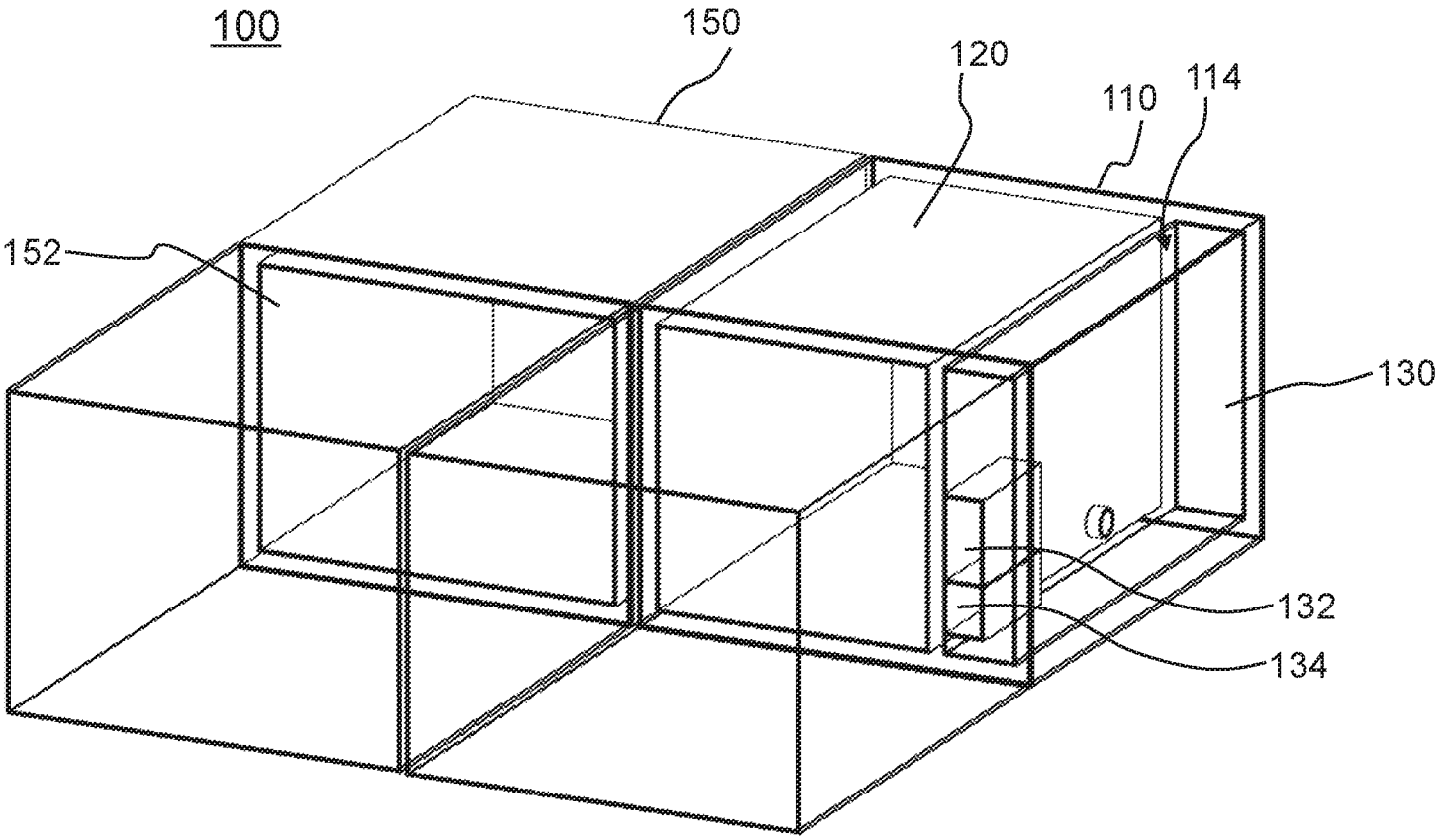
FIG. 2 schematically shows the example fluid container of FIG. 1 in perspective view.

FIG. 2 schematically shows the example fluid container 100 of FIG. 1 in perspective cutaway view. In this example, each of the primary module 110 and the secondary module 150 are cuboidal and of substantially similar dimensions. The primary module 110 and secondary module 150 are in side-to-side configuration and are each elongate along parallel longitudinal axes. The cutaway view of FIG. 2 shows a forward portion of each module 110, 150 in wireframe to expose an interior view of the arrangement of the respective modules. In this example configuration, the regulated chamber 130 occupies a position at one lateral side of the primary module (the right side in FIG. 2), and the primary reservoir 120 extends from the regulated chamber 130 to the opposing lateral side of the primary module 110 adjacent the secondary module 150 and secondary reservoir 152. Accordingly, in this example the primary reservoir 120 is disposed between the regulated chamber 130 and the secondary reservoir 152.

In this particular example, the regulator unit 132 is disposed within the regulated chamber 130 and mounted on the first wall 114 separating the regulated chamber 130 and the primary reservoir 120. The gas control valve 134 is mounted on the first wall 114 for controlling the relief gas flow through a valve outlet port formed in the first wall 114.

Figure 4:
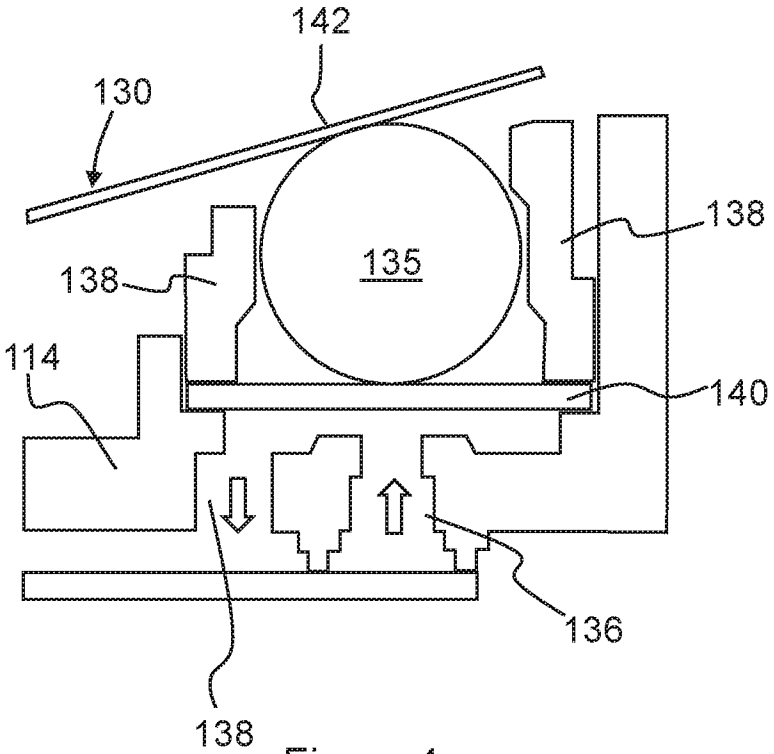
FIGS. 3 and 4 schematically show two configurations of an example gas control valve.
Figure 3:
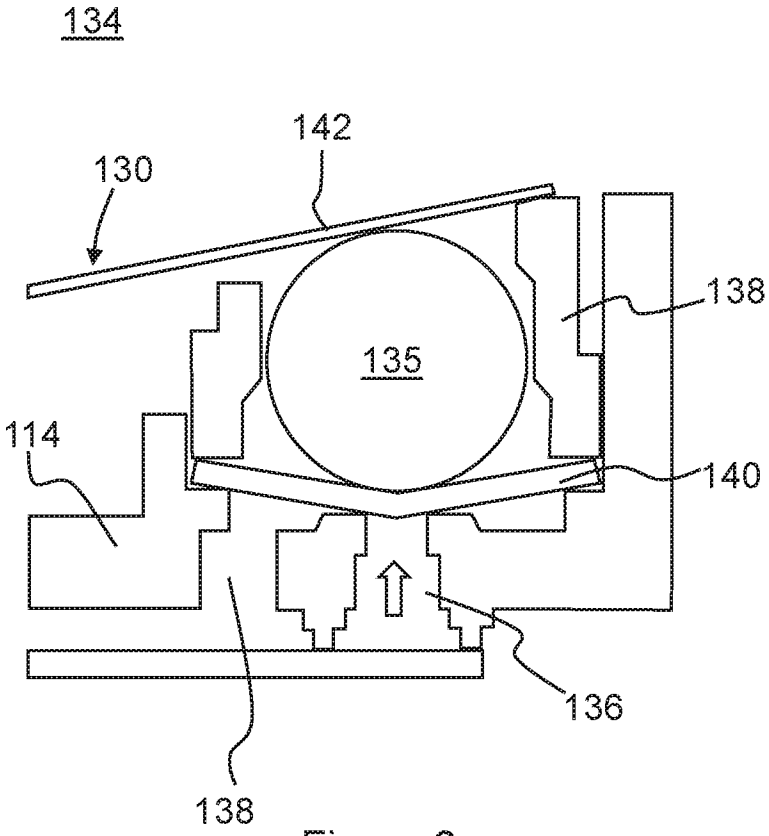

FIGS. 3 and 4 show an example gas control valve 134 for use in the fluid container 100 of FIGS. 1 and 2. The example gas control valve 134 comprises a valve inlet port 136 and an adjacent valve outlet port 138 in the first wall 114 coupled to respective flow pathways on the opposite side of the wall to the regulated chamber 130. In this example a disc valve member 140 is located within a corresponding retaining arrangement to oppose the gas ports 136, 138. For example, the retaining arrangement may comprise an annular retaining protrusion integrally formed with the first wall 114 of the regulated chamber 130. In this example, a ball actuator 135 is received over the disc valve member and retained to act on the disc valve member by a locator collar 138. In this example, the locator collar 138 is to restrict lateral movement of the actuator ball 134 relative a valve axis corresponding to opening and closing movement of the disc valve member 140 as will be described in detail below. An actuating arm 142 of the regulator unit 132 extends over the ball actuator on the opposite side of the ball actuator to that which acts on the disc valve member 140, so as to drive actuating movement of the ball actuator 135 towards the first wall and permit returning movement of the ball actuator 135 away from the first wall as the regulator unit 132 moves between respective configurations.

FIG. 3 shows the gas control valve 134 in a closed configuration corresponding to a first configuration of the regulator unit 132 in which the actuating arm 142 depresses the ball actuator 135 within the locator collar 138 to deform the disc valve member so that it seats on the valve inlet port 136. In other words, the opening of the valve inlet port 136 forms a valve seat for the disc valve member. Accordingly, in this configuration the flow of relief gas is stopped.

FIG. 4 shows the gas control valve 134 in an open configuration corresponding to a second configuration of the regulator unit 132 in which the actuating arm 142 lifts away from the first wall 114 to permit the ball actuator 135 to move away from the first wall under a resilient action of the disc valve member or a pressure differential between the gas flow path and the print fluid in the regulated chamber 130, which in this example is biased to a substantially flat configuration as shown in FIG. 4. In this configuration, the disc valve member is suspended over the openings of the valve inlet port 136 and valve outlet port 138 so that there is a manifold for fluid communication between the valve inlet port 136 and the valve outlet port 138 defined between the first wall and the side of the disc valve member 140 opposite the ball actuator 135. Accordingly, in this configuration, the flow of relief gas is permitted to flow through the gas control valve 134.

Figure 5:
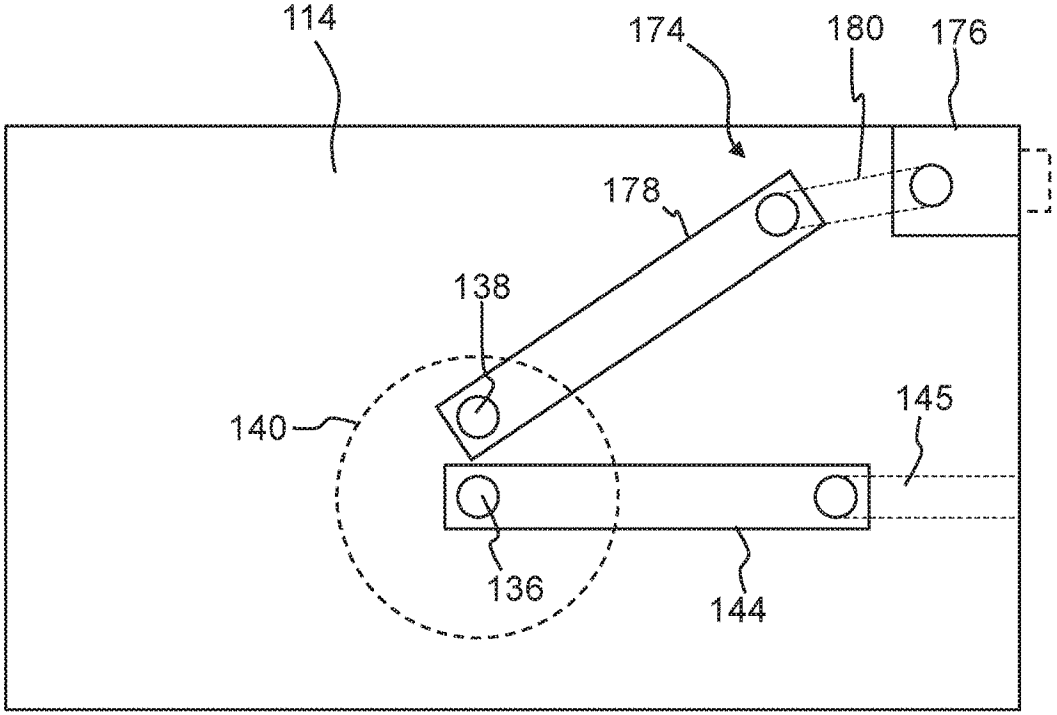
FIG. 5 schematically shows a first wall of a body for a primary module of an example fluid container.

FIG. 5 shows the first wall 114 of the example fluid container of FIGS. 1 and 2 as viewed from within the primary reservoir 120. As shown in FIG. 5, the valve inlet port 136 and valve outlet port 138 are located substantially adjacent one another within a footprint of the disc valve member 140 (shown in dashed lines) of the gas control valve on the opposing side of the first wall 114.

The first wall 114 comprises a gas inlet channel 144 which in this example is integrally formed as a recess in the first wall 114 and which extends from a gas supply port 145 to the valve inlet port 136.

As described above, the example fluid container 100 comprises a bypass portion 174 which extends from the valve outlet port 138 along the first wall 114 to the outlet chamber 176. As shown in FIG. 5, the bypass portion 174 comprises a bypass channel 178 which in this example is integrally formed as a recess in the first wall 114 and which extends from the valve outlet port 138 to a link channel 180 which fluidically couples the bypass channel to the outlet chamber 176. In this example the link channel 180 is a cavity within the first wall 114. In other examples, the link channel may comprise a conduit outside of the first wall 114, or there may be no link channel and the bypass channel 178 may extend directly to an outlet chamber 176.

The recess may be formed as a groove in the first wall 114, or may be defined by raised protrusions on the first wall 114, which may be integrally formed with or otherwise mounted to the first wall 114.

In the example of FIG. 5, the wall 114 is formed as a unitary structure so that the gas inlet channel 144 and the bypass channel 178 are open along their length to the primary reservoir. The wall 114 may be integrally formed as part of a body for the primary module, for example by injection moulding.

Figure 6:
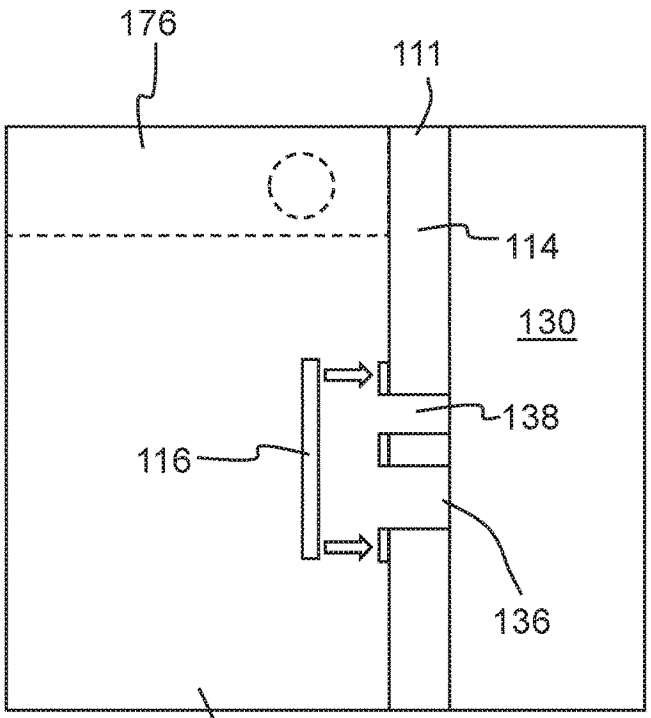
FIG. 6 schematically shows a cross-sectional view of the example body of FIG. 5.

FIG. 6 shows a partial cross-section of a body 111 for the primary module 110 of FIGS. 1 and 2 bisecting the valve inlet port 136 and valve outlet port 138 formed in the first wall. For clarity of orientation, the location of the outlet chamber 176 is shown in dashed lines. As described above with respect to FIG. 5, terminal ends of the gas inlet channel 144 and bypass channel 178 terminate at the valve inlet port 136 and gas outlet port 138 respectively. In order to close the respective channels 144, 178 one or more enclosures 116 are provided over the channels so that the gas flow therethrough is separated from any print fluid contained in the primary reservoir 120. For example, the enclosure 116 may be a film adhered to side walls of the respective channels.

An example of use in a print operation will now be described with reference to the example fluid container of FIGS. 1 and 2 (example parts of which are shown in further detail in FIGS. 3-6). In use, each of the regulated chamber 130, primary reservoir 120 and secondary reservoir 150 are charged with a print fluid and the fluid container 100 is loaded into a print apparatus. Print fluid is drawn or discharged from the regulated chamber 130 on demand. The regulator unit 132 moves from the first configuration corresponding to the closed configuration of the gas control valve 134 (FIG. 3) to the second configuration corresponding to the open configuration of the gas control valve 134 (FIG. 4) to permit a flow of relief gas to flow into the fluid container via the gas inlet channel 144 to the gas control valve 134, and along the relief gas pathway 170 from the gas control valve 134 to the secondary reservoir 152. In this particular example, the relief gas pathway 170 includes the bypass channel 178, link channel 180, outlet chamber 176, upper port 118 of the primary module, relief conduit 172, and the upper port 154 of the secondary module 150.

As print fluid is discharged from the regulated chamber, print fluid is replenished to the regulated chamber from the primary reservoir 120 via the primary re-supply conduit 112, and print fluid is replenished to the primary reservoir 120 from the secondary reservoir 152 via the secondary re-supply conduit. Discharge of print fluid from the secondary reservoir 152 to replenish the primary reservoir causes relief gas to flow along the relief gas pathway into the secondary reservoir.

In use, print fluid is progressively drained from the secondary reservoir 152 to keep the primary reservoir 120 charged with print fluid, such that relief gas is first provided to the primary reservoir 120 via the secondary re-supply conduit 160 when the level of print fluid in the secondary reservoir is below a threshold. This threshold may correspond to the physical level of the secondary re-supply conduit 160.

In use, the print fluid may foam or bubble as relief gas is supplied to it, particularly if relief gas is received in a respective reservoir via an inlet submerged below the level of the print fluid. Print fluid may be particularly prone to foaming during high speed printing, for example. In the example fluid container of FIGS. 1-2, relief gas is first received in the secondary reservoir 152 to displace print fluid therein, and subsequently received in the primary reservoir 120 to displace print fluid received therein. In other words, there is a one-way flow path from the secondary reservoir 152 to the primary reservoir 120 and on to the regulated chamber 130 for print fluid, and subsequently for relief gas. Therefore, any foam or bubbles forming adjacent a re-supply conduit do not tend to block flow therethrough, as any resistance to flow presented by the foam or bubbles is overcome by a pressure differential that builds as print fluid is discharged from the fluid container.

Fluid containers may be provided in a plurality of different sizes to form a family of fluid containers. An unextended fluid container may comprise a primary module having a regulated chamber and a primary reservoir, without any additional secondary module. In such a fluid container, relief gas may be provided directly from a gas control valve as described above into the primary reservoir, for example through a valve outlet port formed in a first wall separating the primary reservoir and the regulated chamber, which opens into the primary reservoir.

An extended fluid container may comprise a secondary module comprising a secondary reservoir in addition to the primary module to provide an expanded supply of print fluid. In one previously-considered example of an extended fluid container, the secondary module could be coupled to the primary module with two free-flow conduits extending between the primary reservoir and the secondary reservoir at upper and lower positions for the exchange of relief gas and print fluid respectively. In such an arrangement, relief gas would be provided direct to the primary reservoir as in an unextended fluid container and would be free to flow onto the secondary reservoir from the primary reservoir. Accordingly, levels of print fluid in the primary and secondary reservoirs may reduce at the same time. In such an arrangement, foam or bubbles may form in the primary reservoir and collect adjacent an upper free-flow conduit. This may block the flow of relief gas from between the reservoirs. As print fluid is discharged from the primary reservoir to the regulated chamber, the primary reservoir would be replenished with relief gas, and so the primary and secondary reservoirs may be at substantially the same pressure. Accordingly, any foam or bubbles blocking a free-flow conduit between the two reservoirs in this previously-considered configuration may resist exchange of relief gas between the first and second reservoirs such that print fluid in the secondary reservoir is not released.

The example (extended) fluid container 100 described above with respect to FIGS. 1-6 may be less susceptible to such blocking owing since the secondary reservoir is to receive relief gas from the gas control valve, and the primary reservoir is to receive relief gas via the secondary reservoir. Accordingly, there may be a one-way flow path for relief gas and print fluid, such that any blockage along the path may be overcome by a pressure differential that may build as print fluid is discharged from one end of flow path.

The example fluid container 100 may be provided as part of a family of fluid containers of different sizes, and in this context may be referred to as an extended fluid container as it comprises both a primary module 110 and a secondary module 150. The family may include an unextended fluid container as described above, in which relief gas flows directly form the gas control valve to the primary reservoir. The unextended and extended fluid containers may share common features of configuration, in particular features of the regulated chamber. Such common features may provide for economies in supply and manufacturing. Example extended fluid containers may provide a relief gas pathway to divert relief gas from the gas control valve to the secondary reservoir (rather than directly to the primary reservoir) as described above. In some examples such as those shown in FIGS. 1-6, the primary reservoir may be disposed between the regulated chamber and the secondary reservoir. The relief gas pathway may comprise a bypass portion to bypass the primary reservoir, which may for example include a bypass channel formed in a first all separating the primary reservoir from the secondary reservoir.

Figure 7:
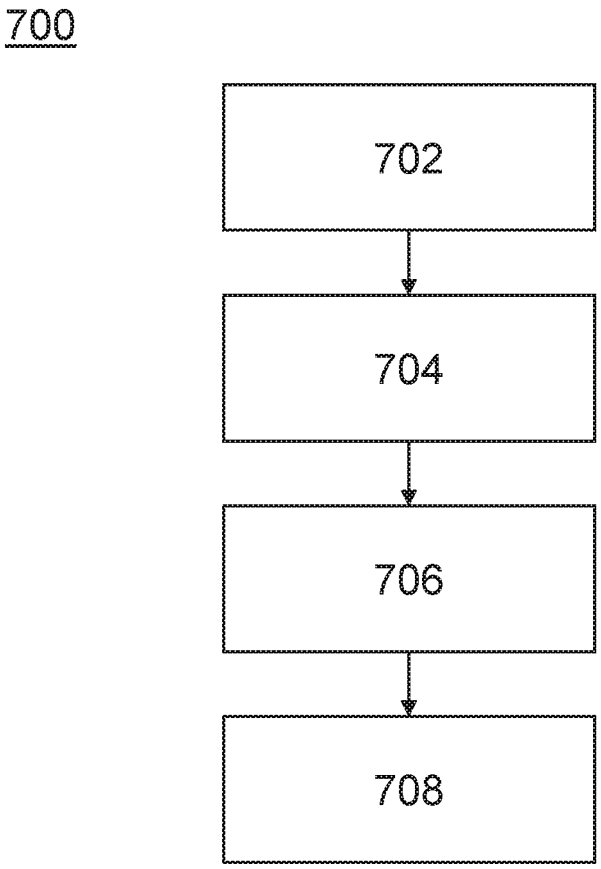
FIG. 7 is a flowchart of a method for assembling a fluid container.

FIG. 7 shows an example method 700 for assembling a fluid container. By way of example, the method will be described with respect to the example fluid container 100 described above with respect to FIGS. 1-6.

In block 702 a body 111 for the primary module 110 of the fluid container 110 is provided. The body 111 may be a unitary structure, for example as formed by injection moulding. In this example, the body 111 forms the main structural walls of the primary module 110 including the first wall 114 as described above with respect to FIGS. 1 and 2. The body therefore comprises the primary reservoir 120 to contain print fluid and the regulated chamber 130 to receive print fluid from the primary reservoir, together with the first wall 114 separating the primary reservoir 120 and the regulated chamber 130.

The body 111 may be provided in a configuration in which there is a valve outlet port 138 in the wall 114 such that a flow of relief gas from a gas control valve 134 subsequently installed would flow directly into the primary reservoir 120.

In this example, the body 111 further comprises a bypass channel 178 formed in the wall 114 as described above.

In block 704, an enclosure 116 is provided over the valve outlet port 138 and the bypass channel 178 to divert relief gas flowing through the outlet gas port along the bypass channel to an outlet port of the body 111 for the primary module, for example the upper port 118 of the primary module as described above.

In block 706, a regulator unit 132 and gas control valve 134 as described above are installed in the regulated chamber to control delivery of relief gas through the valve outlet port 138.

In block 708, a secondary module 150 including a secondary reservoir 152 to contain print fluid is provided. The secondary module is coupled to the primary module to receive the relief gas via the outlet port 118 of the primary module 110.

In some examples, providing the secondary module be coupled to the primary module so that the primary reservoir 120 is disposed between the regulated chamber 130 and the secondary reservoir 152.

In some examples providing the secondary module may further comprise installing a conduit between the outlet port of the primary module and an inlet port of the secondary module to provide a gas relief pathway from the gas control valve 134 to the secondary reservoir 152. For example, a relief conduit 172 may be installed between upper ports 118, 154 of the primary and secondary modules 110, 150 as described above with respect to FIG. 1.

The relief gas pathway may include a bypass portion 174 comprising the bypass channel 178 in the first wall 114.

Figure 8:
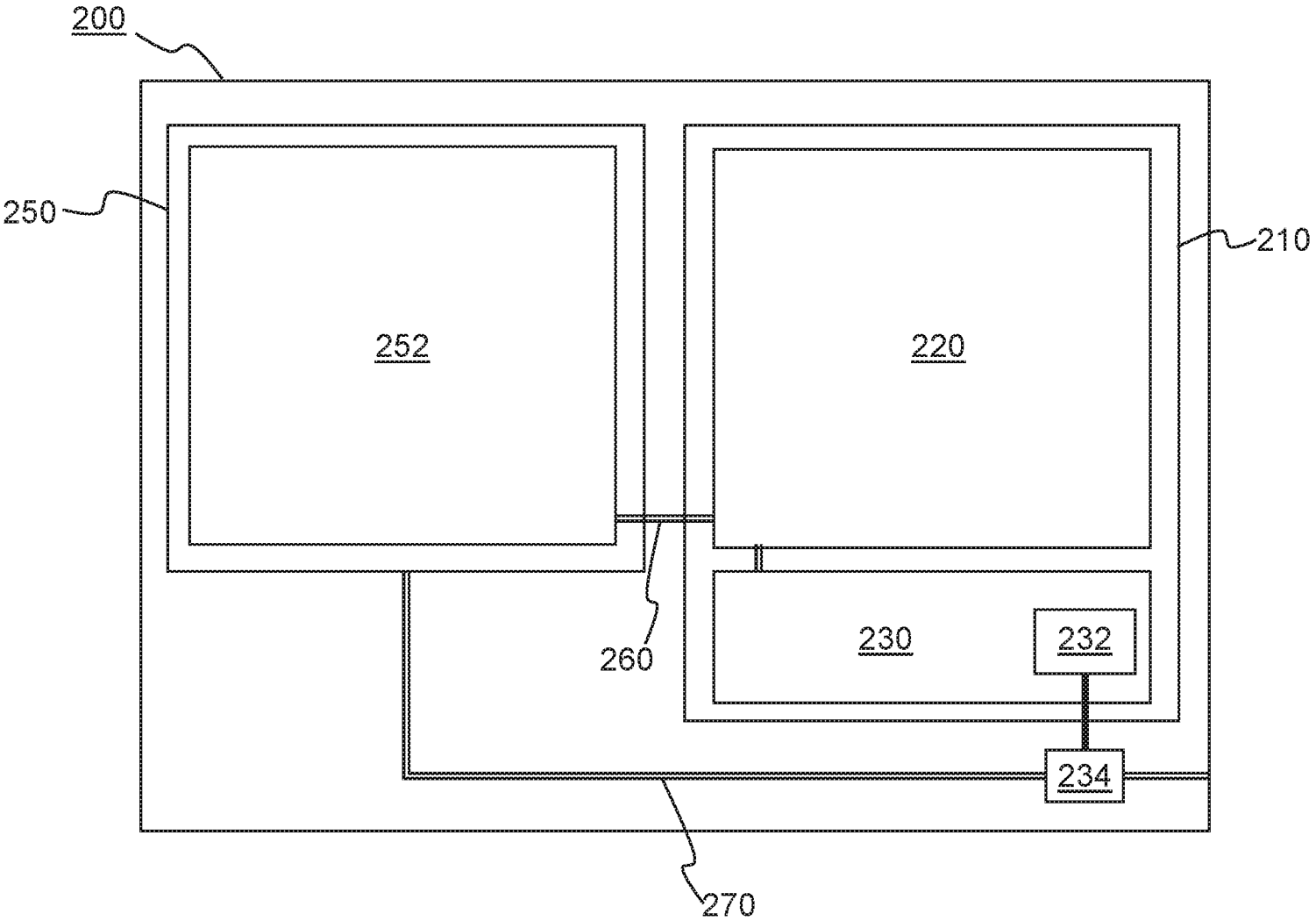
FIG. 8 schematically shows a further example of a fluid container.

FIG. 8 schematically shows a further example of a fluid container 200 useable with print apparatus. The fluid container comprises a primary module 210 comprising a primary reservoir 220 to contain print fluid and a regulated chamber 230 to receive the print fluid from the primary reservoir 220. The regulated chamber 230 comprises a regulator unit 232 to actuate a gas control valve 234 to control a flow of relief gas into the fluid container 200 as print fluid is discharged from the fluid container 200. The fluid container comprises a secondary module 250 comprising a secondary reservoir 252 to contain print fluid. The primary reservoir 220 is to receive the print fluid from the secondary reservoir 252 via a re-supply conduit 260 between the secondary reservoir 252 and the primary reservoir 220. The secondary reservoir 252 is to receive the relief gas via the gas control valve 234, and the primary reservoir 220 is to receive the relief gas via the secondary reservoir 252.

In this particular example, a relief gas pathway 270 between the gas control valve 234 and the secondary reservoir 252 is separate from any wall separating the primary reservoir 220 and the regulated chamber 230. For example the relief gas pathway 270 may be provided by a conduit outside the primary and secondary modules.

Example print fluids which may be contained in an example fluid container may include inks; print agents for additive manufacturing such as coalescing, fusing, or detailing agents. The print fluid may be water.

Additive manufacturing techniques may generate a three-dimensional object through the solidification of a build material. The build material may be powder-based and the properties of generated objects may depend on the type of build material and the type of solidification mechanism used. In a number of examples of such techniques including sintering techniques, build material is supplied in a layer-wise manner and the solidification method includes heating the layers of build material to cause melting in selected regions. In other techniques, chemical solidification methods may be used.

Additive manufacturing systems may generate objects based on structural design data. This may involve a designer generating a three-dimensional model of an object to be generated, for example using a computer aided design (CAD) application. The model may define the solid portions of the object. To generate a three-dimensional object from the model using an additive manufacturing system, the model data can be processed to generate slices of parallel planes of the model. Each slice may define a portion of a respective layer of build material that is to be solidified or caused to coalesce by the additive manufacturing system.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims, Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A fluid container useable with print apparatus, comprising:

a primary module comprising:

a primary reservoir to contain print fluid;

a regulated chamber to receive the print fluid from the primary reservoir, the regulated chamber comprising a regulator unit to actuate a gas control valve to control a flow of relief gas into the fluid container as print fluid is discharged from the fluid container;

a secondary module comprising a secondary reservoir to contain print fluid;

wherein the primary reservoir is to receive the print fluid from the secondary reservoir via a re-supply conduit between the secondary reservoir and the primary reservoir; and wherein the secondary reservoir is to receive the relief gas via the gas control valve, and the primary reservoir is to receive the relief gas via the secondary reservoir.

2. A fluid container according to claim 1, wherein the primary reservoir is disposed between the regulated chamber and the secondary reservoir.

3. A fluid container according to claim 1, wherein the fluid container comprises a relief gas pathway to deliver relief gas from the gas control valve to the secondary reservoir;

wherein a bypass portion of the relief gas pathway extends along a first wall of the primary module separating the primary reservoir from the regulated chamber.

4. A fluid container according to claim 3, wherein the gas control valve comprises a valve member disposed in the regulated chamber and a valve seat formed in or mounted to the first wall of the primary module separating the primary reservoir from the regulated chamber.

5. A fluid container according to claim 3, wherein the bypass portion is defined by a channel integrally formed in the first wall and an enclosure disposed over the channel to separate the bypass portion from print fluid in the primary reservoir.

6. A fluid container according to claim 3, wherein the primary module further comprises a relief outlet chamber forming part of the bypass portion of the relief gas pathway;

wherein the relief outlet chamber is to receive relief gas from the bypass portion;

wherein an outlet port of the primary module is to discharge relief gas from the relief outlet chamber; and wherein the primary module comprises a second wall separating the relief outlet chamber from the primary reservoir.

7. A fluid container according to claim 1, further comprising a gas inlet pathway to deliver relief gas from an inlet of the fluid container to the gas control valve, wherein a portion of the gas inlet pathway is formed in the first wall of the primary module separating the primary reservoir from the regulated chamber.

8. A fluid container useable with print apparatus comprising:

a primary module comprising:

a primary reservoir to contain print fluid;

a regulated chamber to receive the print fluid from the primary reservoir, the regulated chamber comprising a regulator unit to actuate a gas control valve to control a flow of relief gas into the fluid container as print fluid is discharged from the fluid container;

a secondary module comprising a secondary reservoir to contain print fluid;

a relief gas pathway to deliver a flow of relief gas from the gas control valve to the secondary reservoir;

wherein the relief gas pathway bypasses the primary reservoir and wherein a bypass portion of the relief gas pathway extends along a first wall separating the primary reservoir and the regulated chamber.

9. A fluid container according to claim 8, wherein the primary reservoir is disposed between the regulated chamber and the secondary reservoir.

10. A fluid container according to claim 8, wherein the bypass portion is defined by a channel integrally formed in the first wall and an enclosure disposed over the channel to separate the bypass portion from print fluid in the primary reservoir.

11. A fluid container according to claim 8, wherein the gas control valve comprises a valve member disposed in the regulated chamber and a valve seat formed in or mounted to the first wall of the primary module separating the primary reservoir from the regulated chamber.

12. A fluid container according to claim 8, further comprising a gas inlet pathway to deliver relief gas from an inlet of the fluid container to the gas control valve, wherein a portion of the gas inlet pathway is formed in the first wall of the primary module separating the primary reservoir from the regulated chamber.

13. A method comprising:

providing a body for a primary module of a fluid container useable with print apparatus, the body comprising:

a primary reservoir to contain print fluid;

a regulated chamber to receive the print fluid from the primary reservoir;

wherein the primary reservoir and the regulated chamber are separated by a first wall, and wherein there is a valve outlet port in the first wall for a flow of relief gas to be delivered into the fluid container as print fluid is discharged from the fluid container;

providing an enclosure over the valve outlet port and a channel formed in the first wall to divert relief gas flowing through the valve outlet port along the channel to an outlet port of the primary module without entering the primary reservoir;

installing a regulator unit and a gas control valve in the regulated chamber to control delivery of the relief gas through the valve outlet port; and providing a secondary module including a secondary reservoir to contain print fluid and to receive the relief gas via the outlet port of the primary module.

14. A method according to claim 13, wherein the secondary module is coupled to the primary module so that the primary reservoir is disposed between the regulated chamber and the secondary reservoir.

15. A method according to claim 13, further comprising installing a conduit between the outlet port of the primary module and an inlet port of the secondary module to provide a gas relief pathway from the gas control valve to the secondary reservoir including a bypass portion defined by the channel in the first wall.

16. A fluid container according to claim 1, wherein the regulator unit comprises a sealed expandable chamber to expand and contract in response to pressure change in the regulated chamber to operate the gas control valve.

17. A fluid container according to claim 1, wherein the regulator unit and gas control valve allow relief gas first to enter the regulated chamber, the fluid container further comprising a relief gas pathway from the regulated chamber to the secondary reservoir.

18. A fluid container according to claim 17, wherein the regulator unit is structured to operate the gas control valve to admit relief gas to the regulated chamber when a supply of print fluid in the primary reservoir is depleted to a predetermined level.

19. A fluid container according to claim 1, wherein the regulator unit comprises a ball actuator in a locator collar that is driven to act on a disc valve member to open or close the gas control valve.

20. A fluid container according to claim 1, wherein discharge of print fluid from the secondary reservoir to replenish the primary reservoir causes relief gas to flow along a relief gas pathway into the secondary reservoir from the regulated chamber.

* * * * *